US007261292B2

(12) United States Patent
Butterfass et al.

(10) Patent No.: US 7,261,292 B2
(45) **Date of Patent: *Aug. 28, 2007**

(54) METHOD OF FEEDING SHEETS TO A SHEET-PROCESSING MACHINE, SHEET-SMOOTHING METHOD AND DEVICE

(75) Inventors: Hans Butterfass, Heidelberg (DE); Wolfgang Dolz, Heidelberg (DE); Hendrik Frank, Heidelberg (DE); Andreas Henn, Neckargemünd (DE); Markus Möhringer, Weinheim (DE)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 476 days.

(21) Appl. No.: 10/823,222

(22) Filed: Apr. 12, 2004

(65) Prior Publication Data

US 2004/0201166 A1 Oct. 14, 2004

(30) Foreign Application Priority Data

Apr. 11, 2003 (DE) ..... 103 16 646

(51) Int. Cl.
*B65H 9/04* (2006.01)

(52) U.S. Cl. ..... 271/245; 271/246; 271/264

(58) Field of Classification Search ..... 271/245, 271/246, 264; 101/232, 242, 279
See application file for complete search history.

(56) References Cited

U.S. PATENT DOCUMENTS

| | | | | |
|---|---|---|---|---|
| 4,119,309 | A | 10/1978 | Mayer et al. | |
| 4,355,800 | A * | 10/1982 | Sugiyama | 271/229 |
| 4,505,695 | A | 3/1985 | Billings | |
| 4,522,388 | A * | 6/1985 | Heine et al. | 271/245 |
| 4,613,125 | A * | 9/1986 | Jeschke | 271/227 |
| 5,191,379 | A | 3/1993 | Manzer et al. | |
| 6,655,682 | B2 * | 12/2003 | Becker et al. | 271/245 |

FOREIGN PATENT DOCUMENTS

| | | |
|---|---|---|
| DE | 1 112 540 | 8/1961 |
| DE | 38 08 477 A1 | 9/1989 |
| DE | 100 11 186 A1 | 9/2001 |

* cited by examiner

*Primary Examiner*—David H. Bollinger
(74) *Attorney, Agent, or Firm*—Laurence A. Greenberg; Werner H. Stemer; Ralph E. Locher

(57) ABSTRACT

In a method and an apparatus for feeding sheets to a sheet-processing machine, the leading edge of the sheet is smoothed before the grippers are closed by further transport into the sheet-processing machine. A curvature or bend in the sheet transport direction is imparted to the sheet. The feed table has, in its feeder region, a curvature in the sheet transport direction, against which curvature the sheet leading edge is laid with the aid of pneumatic or mechanical devices.

17 Claims, 4 Drawing Sheets

METHOD OF FEEDING SHEETS TO A SHEET-PROCESSING MACHINE, SHEET-SMOOTHING METHOD AND DEVICE

BACKGROUND OF THE INVENTION

Field of the Invention

The invention lies in the mechanical sheet-processing field. More particularly, the invention pertains to an apparatus for guiding sheets to a sheet-processing machine, in particular to a printing press. The assembly has a feed table and a feeder region provided at the end of the feed table with aligning means for lateral and circumferential alignment of the sheets.

In order to enable a transfer of a sheet accurately to a further transport device, for example a pregripper, after alignment in the feeder region of the feed table, the respective sheet must have an unstressed and optimally smoothed sheet leading edge.

It is known in the art, for example, to provide so-called smoothing brushes or sheet hold-downs and to used them to act mechanically on the sheet from above and avoid the formation of corrugation waves.

German published patent application DE 100 11 186 A1 describes a pneumatic sheet-smoothing device. In its feeder region, a feed table has, in the feed plane, so-called blowing/suction nozzles, by means of which a flow running parallel with respect to the surface of the feed table is generated. The flow produces a vacuum on the underside of the side of the sheet facing the feeder table, in order that the side rests on the feed table. The blown air jets are aligned diagonally with cutouts in the feed table which are provided for gripper stops of the pregripper.

SUMMARY OF THE INVENTION

It is accordingly an object of the invention to provide a sheet-smoothing method and device which overcome the above-mentioned disadvantages of the heretofore-known devices and methods of this general type and which ensure that the sheet leading edge has a smoothed sheet leading edge immediately before further transport to the sheet-processing machine.

With the foregoing and other objects in view there is provided, in accordance with the invention, a method of feeding sheets to a sheet-processing machine. The method comprises the following steps:

placing a sheet with a leading edge, as defined by a sheet transport direction through the machine, against front lays on a feed table;

smoothing the leading edge of the sheet by imparting to the sheet a curvature in the sheet transport direction; and subsequently gripping the sheet with a further transport device and feeding the sheet into the machine for processing.

With the above and other objects in view there is also provided, in accordance with the invention, an apparatus for feeding sheets to a sheet-processing machine, in particular an apparatus for carrying out the above-summarized method. The apparatus comprises: a feed table formed with a guide surface in a feeder region thereof, the guide surface being curved in a sheet transport direction to the sheet-processing machine, and a smoothing device configured to assist in laying the sheet against the guide surface.

With the above and other objects in view there is also provided, in accordance with the invention, an apparatus for smoothing a leading edge of a sheet, in particular by carrying out the above-summarized method. The assembly is an improved apparatus with a feed table having a plurality of suction openings formed in the feeder region and arranged transversely with respect to a sheet transport direction, and a vacuum device configured to sequentially apply a vacuum to the suction openings one after another, starting from a center opening and in each case laterally outward.

A particular advantage of a smoothed sheet leading edge lies in the fact that it can be gripped very accurately by the following further transport means.

According to one preferred embodiment, the sheet leading edge is smoothed by having a slight curvature in the sheet transport direction imparted to it.

In an advantageous mechanical solution, there is provision for the feed table to have top lays which are arranged on its feeding edge and can be pivoted onto and away from said feeding edge, each have a curvature in the sheet transport direction and thus, together with a guide surface of the feed table, form a pocket for accommodating the sheet leading edge.

In an advantageous pneumatic solution, there is provision for the feed table to have, at its feeding edge, a guide surface having a curvature in the sheet transport direction and to be provided with a number of suction openings transversely with respect to the sheet transport direction, said suction openings sucking the sheet to the curved guide surface of the feed table, with the result that a slight curvature is imparted to the sheet.

In order for it to be possible to attract the sheet by suction in an unstressed manner, there is provision for vacuum to be applied to the suction openings chronologically one after another, starting from the center and in each case toward the outside. It is possible to smooth and unstress the sheet toward the sides by means of this measure. It is also possible to perform this measure in the case of a straight feeder table without curvature.

Other features which are considered as characteristic for the invention are set forth in the appended claims.

Although the invention is illustrated and described herein as embodied in a sheet smoothing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
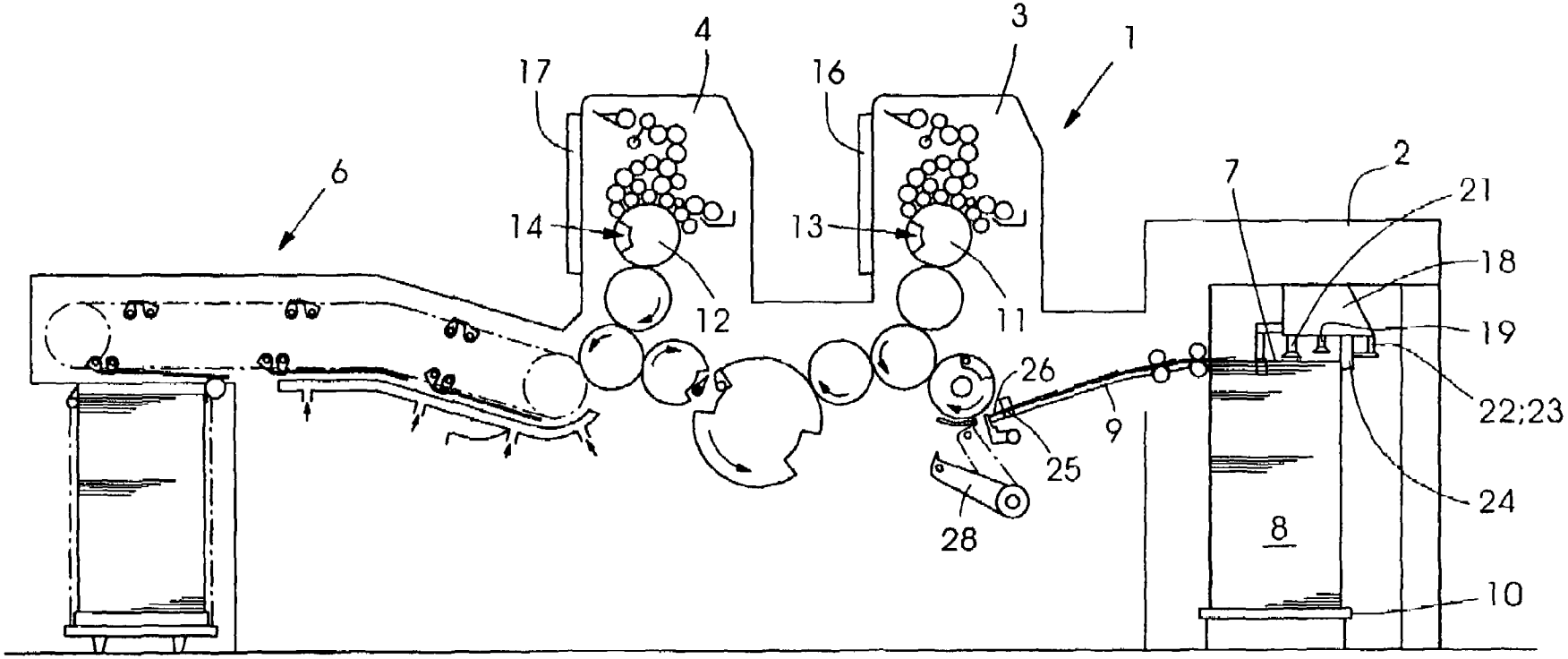
FIG. 1 a diagrammatic longitudinal section taken through a sheet-processing machine in the form of a printing press.

Referring now to the figures of the drawing in detail and first, particularly, to FIG. 1 thereof, there is shown a machine 1 that processes sheets 7. The machine 1—a printing press in the exemplary embodiment—has a feeder 2, at least one printing unit 3 or 4 and a delivery 6. The sheets 7 are removed from a sheet stack or sheet pile 8 and fed individually or overlapped to the printing units 3 and 4 via a feed table 9. The printing units 3 and 4 have respective plate cylinders 11, 12. The plate cylinders 11 and 12 each have an apparatus 13, 14 for fixing flexible printing plates. Furthermore, each plate cylinder 11; 12 is assigned an apparatus 16; 17 for the semiautomatic or fully automatic changing of printing plates.

The sheet stack 8 rests on a stack board or pile board 10 which can be lifted in a controlled manner. The sheets 7 are removed from the upper side of the sheet stack 8 by a so-called suction head 18 which, inter alia, has a number of lifting and dragging suckers 19, 21 to separate the sheets 7. Furthermore, blowing devices 22 are provided for loosening the upper sheet layers and sensing elements 23 for stack tracking. A number of lateral and rear stops 24 are provided for aligning the sheet stack 8, in particular the upper sheets 7 of the sheet stack 8.

Figure 2:
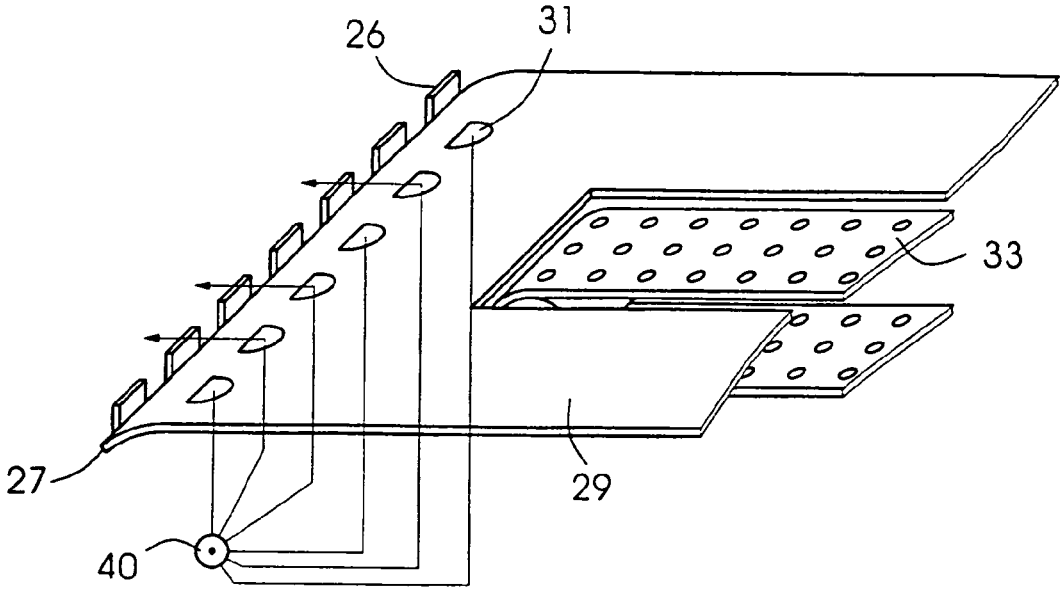
FIG. 2 is a perspective view of a feeder region of a feed table having a curved guide surface and blowing/suction nozzles.

The feed table 9 is configured as what is referred to as a suction belt table and has a feeder region with a feeding edge 27 at its end towards the printing press 1. The feeding edge 27 is configured in such a way that it is possible to set pivotable front and/or top lays 26, 30 and a pivotable pregripper 28 against it cyclically. Side pull lay devices 25 arranged in the edge region of the feed table 9 ensure lateral sheet alignment in the feeder region. In the feeder region, the feed table 9 has a guide surface 29 having a slight curvature in the sheet transport direction, preferably in the downward direction. Pneumatic devices are provided in order that the sheet leading edge also follows the curvature reliably, the former pulling the sheet leading edge against the curved guide surface 29 of the feed table. According to FIG. 2, provision is made here to arrange a number of blowing/suction nozzles 31 transversely with respect to the sheet transport direction. The nozzles each emit a blown air jet which is directed in the sheet transport direction parallel with respect to the guide surface 29 and parallel with respect to the underside of the sheet. The jet produces a vacuum under the sheet and fits the latter snugly against the curvature of the guide surface 29.

Figure 3:
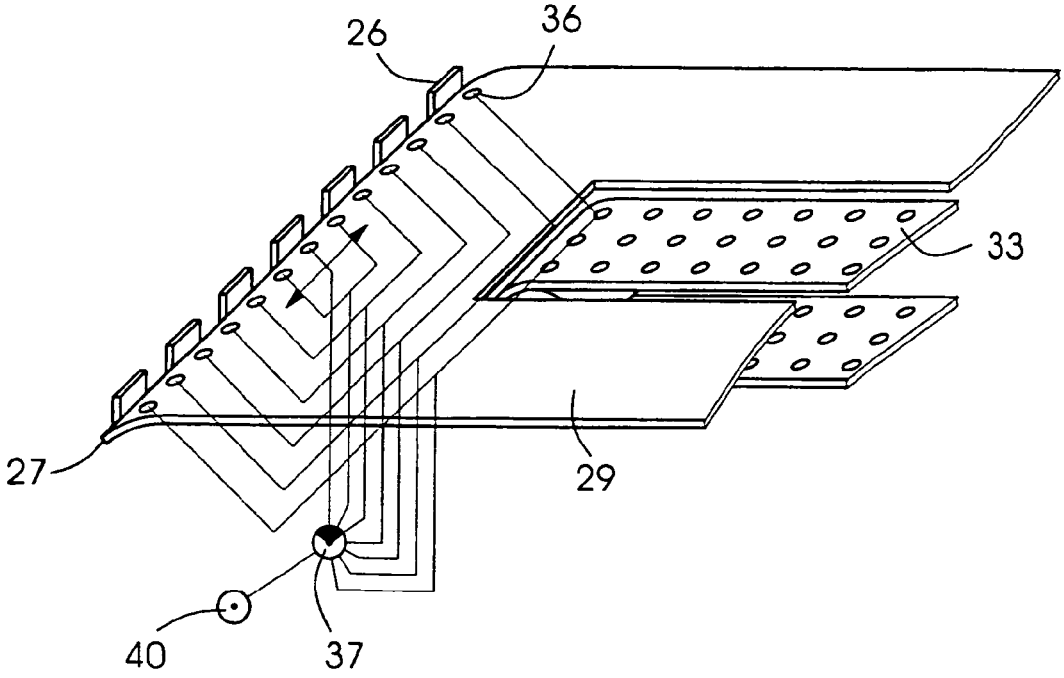
FIG. 3 is a perspective view of the feeder region of the feed table having a curved guide surface and suction openings.
Figure 4:
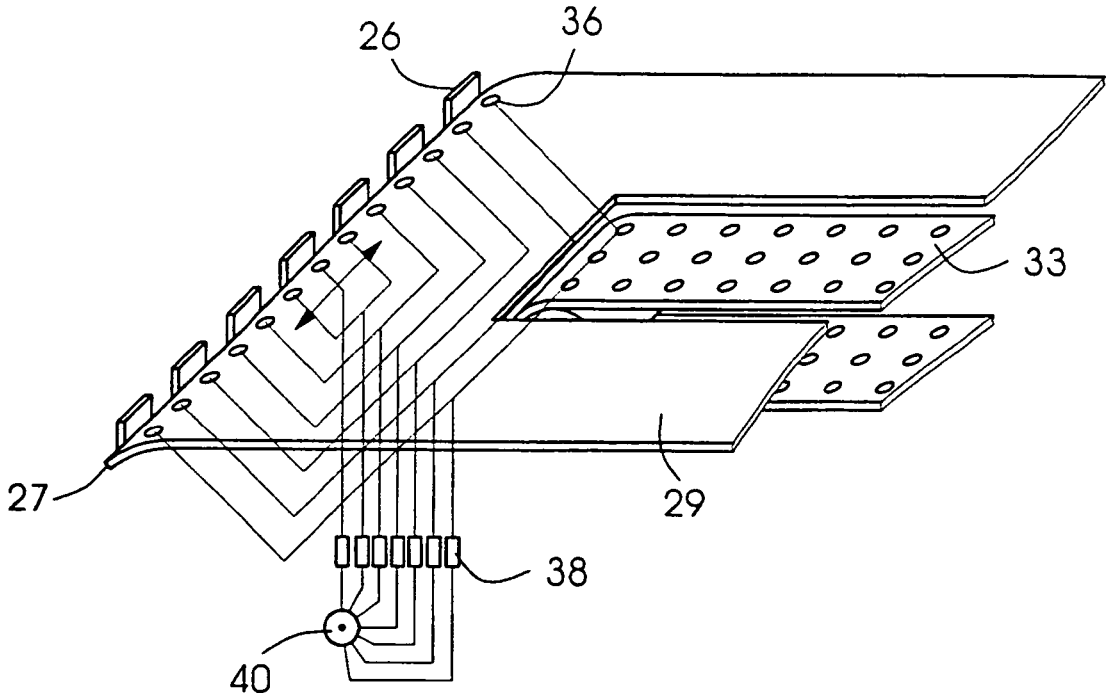
FIG. 4 is a perspective view of the feeder region according to FIG. 3 and having electrically or magnetically driven control valves.

In a further exemplary embodiment, provision is made according to FIG. 3 for the curved guide surface 29 to have a number of suction openings 36 transversely with respect to the sheet transport direction, which suction openings 36 suck the sheet 9, in the region of its leading edge, against the curved guide surface 29. In order to unstress the sheet, there is provision for vacuum to be applied to the suction openings 36 chronologically one after another, starting from the center and in each case toward the outside. The vacuum can be supplied here via a rotary valve 37 or via electrically or magnetically actuatable control valves 38 (FIG. 4) which are connected to a vacuum or blown air source 40, the activation being effected by a control computer of the sheet-processing machine. If the sheet is brought into contact with the curvature via suction openings, the lateral alignment must take place at another instant, that is to say a later instant, as it is not possible to displace the sheet laterally when it is being attracted by suction. It is also conceivable in the other refinements to perform a lateral alignment at an instant other than during contact with the front lays.

Figure 5:
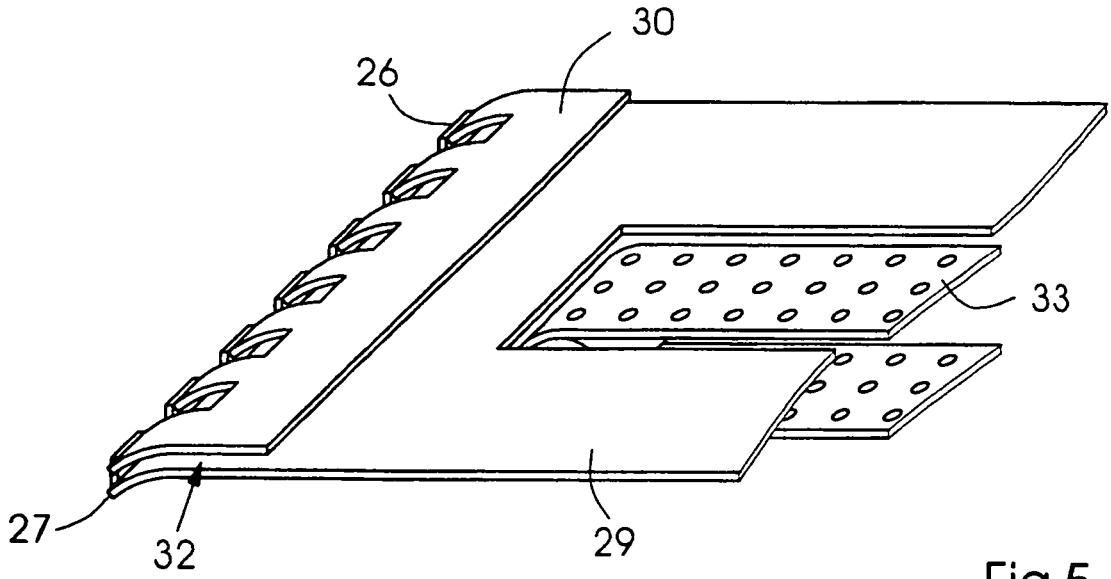
FIG. 5 is a perspective view of the feeder region of the feed table having a curved guide surface and curved top lays.

In a third exemplary embodiment according to FIG. 5, provision is made for the sheet leading edge to be adapted mechanically to the curvature of the guide surface 29. For this purpose, there is provision for top lays 30 to be arranged on the pivotable front lays 26, the former likewise having a curvature adapted to the curvature of the guide surface 29 and the sheet leading edge being inserted into the pocket 32 formed from the top lay 30 and guide surface 29, for example by a transport belt 33 of the suction belt table. The sheet leading edge is in each case smoothed as a result of a curvature in the sheet transport direction being imparted to it.

In the exemplary embodiments shown, the curvature is made in a downward direction in each case. It is also possible to make said curvature in an upward direction, depending on the space requirement or configuration of the sheet transport means.

Figure 6:
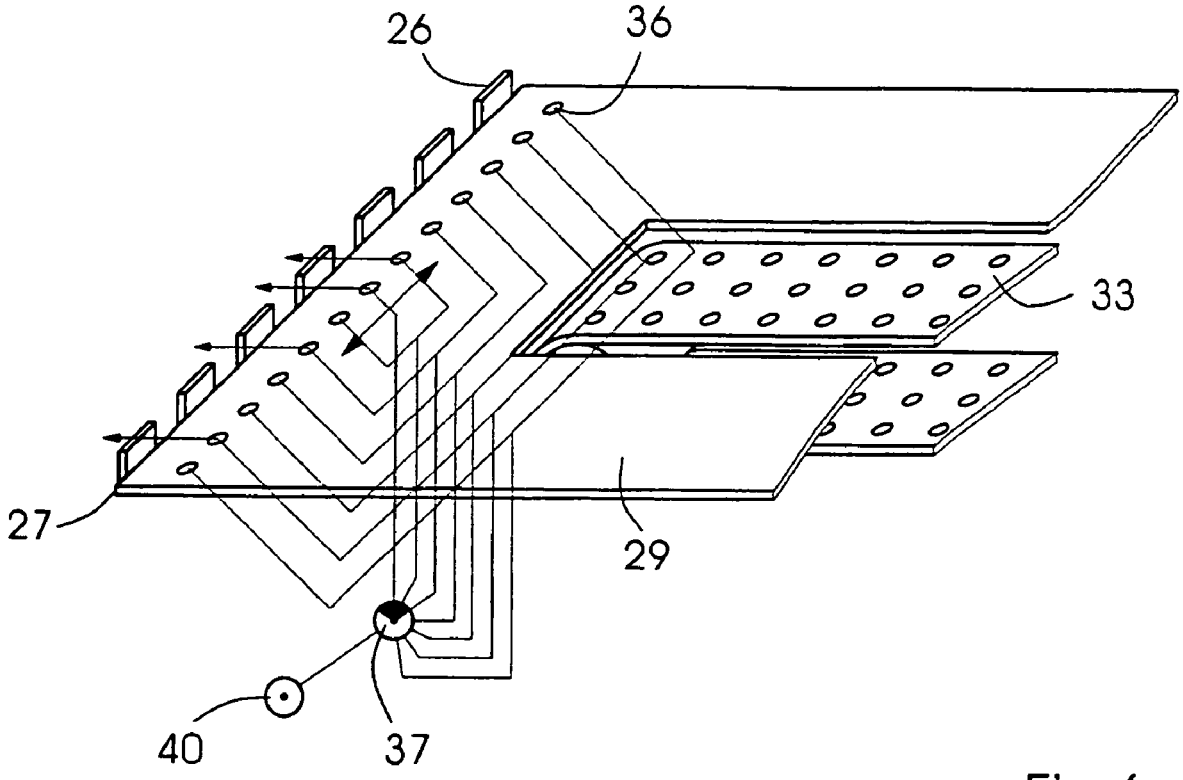
FIG. 6 is a perspective view of a further exemplary embodiment having a straight guide surface and a number of suction openings.

In an exemplary embodiment according to FIG. 6, there is provision for the feed table 9 to be configured, in the feeder region, with a straight conventional guide surface 34 which has a number of suction openings 36 transversely with respect to the sheet transport direction, said suction openings 36 being actuated with vacuum chronologically one after another, starting from the center, in order to suck the sheet against the feed table 9 and therefore achieve smoothing of the sheet leading edge. Actuation can be performed by means of the rotary valve 37 or the electrically or magnetically driven valves 38. In this exemplary embodiment, lateral alignment is also performed at another instant, for example a later instant.

This application claims the priority, under 35 U.S.C. § 119, of German patent application No. 103 16 646.7, filed Apr. 11, 2003; the disclosure of the prior application is herewith incorporated by reference in its entirety.

We claim:

1. A method of feeding sheets to a sheet-processing machine, which comprises the following steps:

placing a sheet with a leading edge, as defined by a sheet transport direction through the machine, against front lays on a feed table with a transport device, where the feed table is formed with a guide surface in a feeder region thereof and the guide surface is curved in the sheet transport direction;

smoothing the leading edge of the sheet by imparting to the sheet a curvature in the sheet transport direction with a smoothing device configured to assist in laying the sheet against the guide surface; and subsequently gripping the sheet with a further transport device.

2. The method according to claim 1, wherein the sheet-processing machine is a printing press and the sheets are cyclically fed to the further transport device.

3. The method according to claim 1, which comprises imparting a downward curvature on the sheet leading edge.

4. The method according to claim 1, which comprises imparting an upward curvature on the sheet leading edge.

5. In a sheet-processing machine, an apparatus for feeding sheets to the sheet-processing machine, comprising: a feed table formed with a guide surface in a feeder region thereof, said guide surface being curved in a sheet transport direction to the sheet-processing machine, and a smoothing device configured to assist in laying the sheet against said guide surface.

6. The apparatus according to claim 5, wherein said smoothing device includes a plurality of blowing/suction nozzles formed in said guide surface transversely with respect to the sheet transport direction and forming blown air jets directed substantially in the sheet transport direction, said plurality of blowing/suction nozzles being configured to assist in laying the sheet against said curved guide surface.

7. The apparatus according to claim 5, which further comprises a plurality of top lays configured for assisting in laying the sheet against said curved guide surface and adapted to a curvature of said curved guide surface.

8. The apparatus according to claim 7, wherein said curved guide surface and said curved top lays together form a pocket for receiving therein the sheet leading edge.

9. The apparatus according to claim 5, wherein said curved guide surface is formed with a plurality of suction openings arranged transversely with respect to the sheet transport direction.

10. The apparatus according to claim 9, which comprises a vacuum device having a valve, said vacuum device configured to apply a vacuum to said suction openings chronologically one after another, starting from a center and proceeding laterally outwardly.

11. The apparatus according to claim 10, wherein said valve is a rotary valve.

12. The apparatus according to claim 10, wherein said valve is a plurality of electrically driven control valves.

13. The apparatus according to claim 10, wherein said valve is a plurality of magnetically driven control valves.

14. In an apparatus for guiding sheets to a sheet-processing machine, the apparatus having a feed table with a feeder region, the improvement which comprises: the feed table having a plurality of suction openings formed in the feeder region and arranged transversely with respect to a sheet transport direction, and a vacuum device having a valve, said vacuum device configured to sequentially apply a vacuum to said suction openings one after another, starting from a center opening and in each case laterally outward.

15. The apparatus according to claim 14, wherein said valve is a rotary valve.

16. The apparatus according to claim 14, wherein said valve is a plurality of electrically driven control valves.

17. The apparatus according to claim 14, wherein said valve is a plurality of magnetically driven control valves.

* * * * *